US011320119B2

(12) United States Patent
Riihilahti

(10) Patent No.: US 11,320,119 B2
(45) Date of Patent: May 3, 2022

(54) BEACON LIGHT DEVICE

(71) Applicant: Obelux Oy, Helsinki (FI)

(72) Inventor: Sami Riihilahti, Helsinki (FI)

(73) Assignee: Obelux Oy, Helsinki (FI)

( * ) Notice: Subject to any disclaimer, the term of this patent is extended or adjusted under 35 U.S.C. 154(b) by 0 days.

(21) Appl. No.: 17/161,881

(22) Filed: Jan. 29, 2021

(65) Prior Publication Data

US 2021/0239300 A1 Aug. 5, 2021

(30) Foreign Application Priority Data

Jan. 31, 2020 (EP) ..... 20154898

(51) Int. Cl.

| | |
|---|---|
| ***F21V 17/00*** | (2006.01) |
| ***F21V 3/02*** | (2006.01) |
| ***F21V 5/04*** | (2006.01) |
| ***F21V 21/08*** | (2006.01) |
| ***F21Y 115/10*** | (2016.01) |
| ***F21W 111/00*** | (2006.01) |

(52) U.S. Cl.

CPC ..... *F21V 17/002* (2013.01); *F21V 3/02* (2013.01); *F21V 5/045* (2013.01); *F21V 21/08* (2013.01); *F21W 2111/00* (2013.01); *F21Y 2115/10* (2016.08)

(58) Field of Classification Search

CPC ..... F21V 17/002; F21V 21/08; F21V 5/045; F21V 3/02; F21V 23/006; F21V 23/007; F21V 23/009; F21W 2111/00; F21Y 2115/10; F21K 9/238

See application file for complete search history.

(56) References Cited

U.S. PATENT DOCUMENTS

| | | | | |
|---|---|---|---|---|
| 9,080,733 | B2 * | 7/2015 | Rowley | F21K 9/232 |
| 9,989,240 | B2 * | 6/2018 | Ramaiah | F21V 23/009 |
| 10,047,912 | B2 * | 8/2018 | Bosua | H05B 47/19 |
| 10,309,595 | B1 | 6/2019 | Datz et al. | |
| 10,677,438 | B2 * | 6/2020 | Jiang | H05B 45/37 |
| 2014/0062713 | A1 | 3/2014 | Skertich, Jr. et al. | |
| 2016/0131355 | A1 * | 5/2016 | Grajcar | F21K 9/23 362/234 |
| 2017/0184257 | A1 | 6/2017 | Belitz | |
| 2020/0116344 | A1 * | 4/2020 | Dassanayake | F21V 29/51 |

FOREIGN PATENT DOCUMENTS

| | | | |
|---|---|---|---|
| CN | 205155879 | U | 4/2016 |
| JP | 2012227021 | A | 11/2012 |

* cited by examiner

*Primary Examiner* — Peggy A Neils
(74) *Attorney, Agent, or Firm* — Laine IP Oy

(57) ABSTRACT

It is herein proposed a novel beacon light device with a circuit board and an enclosure which at least partially encloses the circuit board. The circuit board features a leading board section and a neck board section which is narrower than the leading board section. The enclosure features a wide opening section which has a width equal to or greater than that of the leading board section for permitting passage of the leading board section through the opening. The enclosure also features a narrow opening section which has a width that is smaller than that of the leading board section for preventing passage of the leading board section through the opening.

17 Claims, 6 Drawing Sheets

BEACON LIGHT DEVICE

FIELD

The present disclosure relates lighting devices for signaling, marking or indicating the presence of an object for navigating maritime or aviation craft. More specifically, the present disclosure relates to a beacon light device for producing a light used in navigation by sea vessels or airplanes.

BACKGROUND

Beacon light devices are used for warning maritime or airborne vessels of the presence of an obstacle. These devices are designed to output a particular light pattern that conforms to the prevailing standards governing such emissions. The devices are typically installed in tall buildings or buoys so as to maximize visibility. Such locations are, however, typically remote and/or difficult to reach. Due to poor reachability, serviceability is a concern because simply arriving to the device is time consuming and because the service personnel must carry the required equipment during the strenuous ascent to the service location.

On the other hand, as the requirements for data transmission between the devices and various networks increases, the devices are becoming ever more complex. The complexity not only emphasizes the serviceability aspect but also sets challenges for the design of the devices to output clear light and data signals.

There is therefore a need for a beacon light device that is constructed in a manner that facilitates convenient servicing and enables effective data transfer.

SUMMARY

It is herein proposed a novel beacon light device with a circuit board and an enclosure which at least partially encloses the circuit board. The circuit board features a leading board section and a neck board section which is narrower than the leading board section. The enclosure features a wide opening section which has a width equal to or greater than that of the leading board section for permitting passage of the leading board section through the opening. The enclosure also features a narrow opening section which has a width that is smaller than that of the leading board section for preventing passage of the leading board section through the opening.

Various embodiments of the novel proposition may comprise at least one feature from the following itemized list:

- the leading board section is, when installed to the enclosure, offset in respect to the wide opening section of the opening;
- the circuit board comprises a main extension dimension which is non-aligned with the wide opening section of the opening so that, when installed, the circuit board cannot be pulled through the opening along the main extension dimension of the circuit board;
- the opening is defined by an edge which is provided to the enclosure, which edge delimits an imaginary plane, the normal of which is parallel to the main extension dimension of the circuit board;
- the opening is defined by an edge which is provided to the enclosure, which edge delimits an imaginary plane, the normal of which is parallel and offset in respect to the main extension dimension of the circuit board;

- the neck board section extends, when installed to the enclosure, through the opening at the narrow opening section of the opening;
- the leading board section is, when installed to the enclosure, at least partly, visible to the outside;
- the circuit board comprises an electronic component mounted on the leading board section;
- the electronic component is outside the enclosure, when the circuit board is installed to the enclosure;
- the light beacon device comprises a light tower mounted to the enclosure, which light tower comprises a hollow body which is in communication with the opening of the enclosure;
- the circuit board extends through the hollow body of the light tower;
- the electronic component is visible to the outside;
- the light beacon device comprises a transparent cover;
- the transparent cover is attached to the enclosure;
- the transparent cover covers the light tower;
- the circuit board is configured to be manipulated during assembly and disassembly between a planar state, in which the leading board section cannot pass through the wide opening section, and a non-planar state, in which the leading board section may pass through the wide opening section;
- the circuit board is configured to be elastically deformed between the planar and non-planar state;
- the circuit board comprises a mechanical joint which is configured to provide manipulation of the circuit board between the planar and non-planar state;
- the enclosure comprises a body with a bottom end and an opposing top end of the body;
- the light beacon device comprises a bottom lid which is configured to the fixed to the body for closing the bottom end of the body of the enclosure;
- the circuit board is fixed to the bottom lid;
- the light beacon device comprises an end plate at the top end of the body;
- the light tower extends from the end plate at the top end of the body,
- the opening is provided to the end plate at the top end of the body.

Considerable benefits are gained with aid of the present proposition. The novel idea of using a circuit board that extends out of the enclosure enables mounting of electronic components such to be more exposed to the ambient, which, in turn, improves the performance of those components. On the other hand, the novel proposition improves the maintenance of beacon light devices as the electronics of the device may be swapped out all at once without touching the optics. That way the device need not be detached from the host structure making servicing more convenient. Further benefits will be discussed in tandem with the description of specific embodiments.

BRIEF DESCRIPTION OF THE DRAWINGS

In the following certain exemplary embodiments are described in greater detail with reference to the accompanying drawings, in which.

EMBODIMENTS

In the present context the expression beacon light device refers to illuminators that are suitable for use as a marker for aiding maritime navigation or aviation safety, i.e. an anti-collision light. Such suitability requires the output of light in a pattern that meets the maritime or aviation requirements for a marker light. Examples for such illuminators include marker lights fitted to buoys as well as obstruction illuminators fitted to tall buildings, such as skyscrapers, wind power plants, and tall bridges. Beacon light devices according to the present meaning are configured to be installed into fixed, i.e. non-moving, objects as opposed to moving vehicles, such as boats or airplanes which may feature anti-collision lights that are not meant by the present expression "beacon light".

In the following paragraphs it is described how, according to certain embodiments, the assembly and disassembly of a beacon light device is facilitated with aid of a novel construction, where a non-uniform circuit board is installed through a non-uniform opening in the enclosure.

Figure 1:
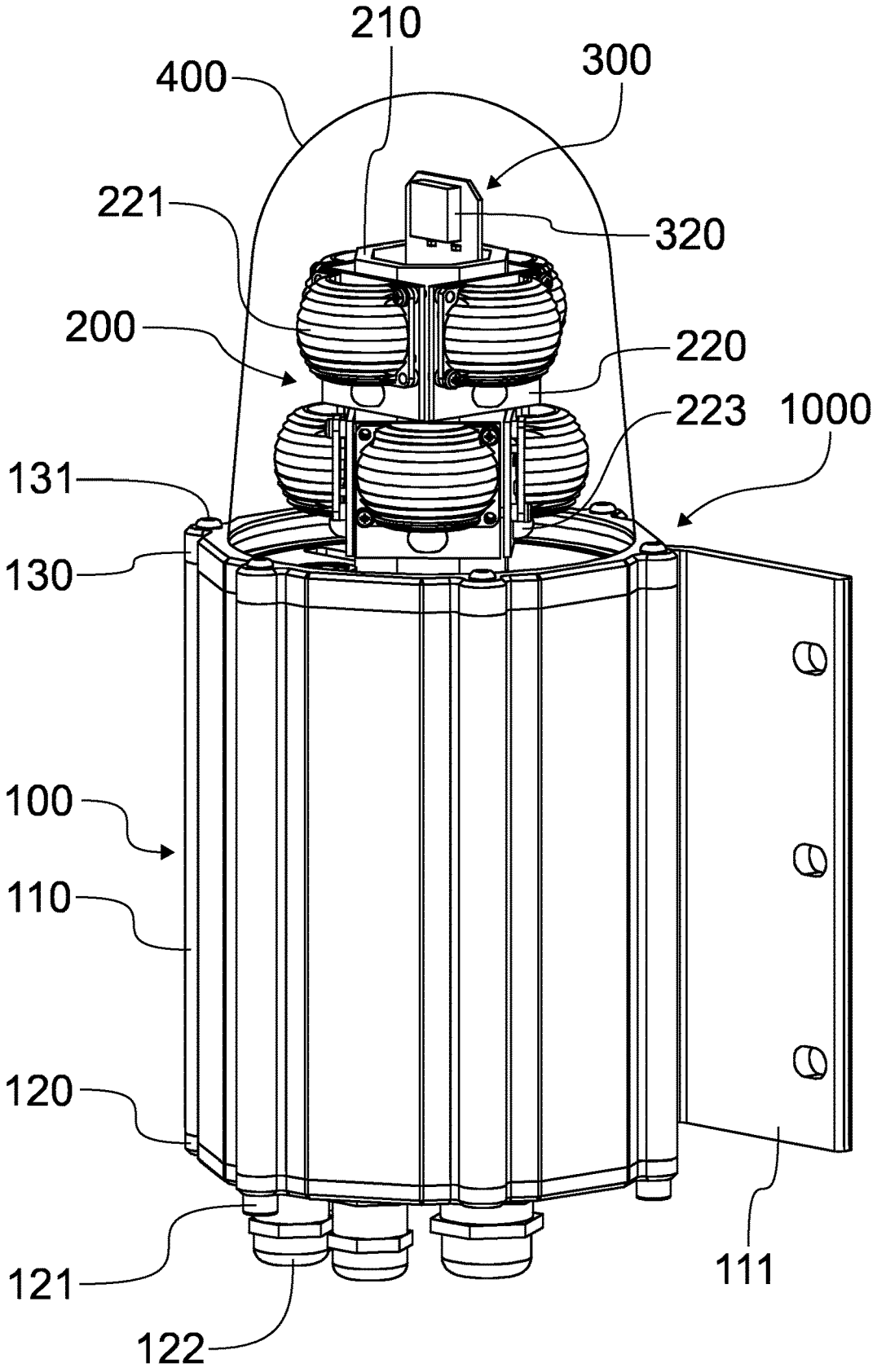
FIG. 1 illustrates a perspective view of a beacon light device in accordance with at least some embodiments.

FIG. 1 illustrates a general view of a beacon light device 1000 according to an exemplary embodiment. The beacon light device 1000 has an enclosure 100 with an elongated body 110 which connects the rest of the elements to the receiving structure, such as a tower or a wind power plant, through a bracket 111. The body 110 has a closed profile for enclosing the internals of the device 1000. The bottom of the enclosure 100 is closed with a bottom lid 120 which is attached to the bottom end of the body 110 with affixers 121, such as screws. The bottom lid 120 includes connectors 122 for connecting the beacon light device 1000 to the host infrastructure. The connectors 122 may be terminals, feedthroughs, etc. The top end of the body 110 is closed with a top lid 130 which is fixed to the top end of the top end of the body 110 with affixers 131, such as screws. The connection between the lids 120, 130 and the body 110 may be sealed with a seal between the respective mating surfaces of the lids 120, 130 and the body 110.

Figure 2:
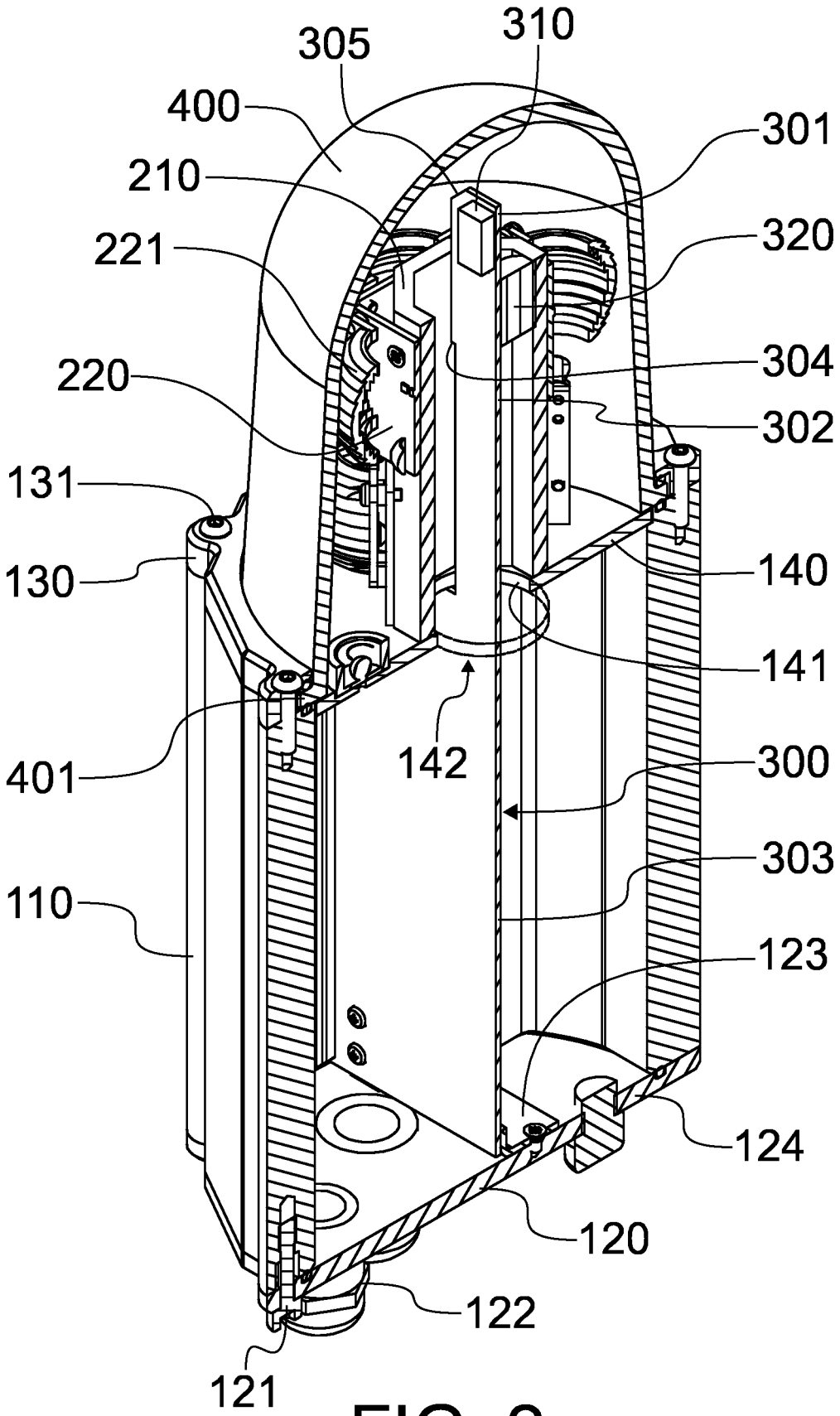
FIG. 2 illustrates a cross-sectional view of the beacon light device of FIG. 1.
Figure 3:
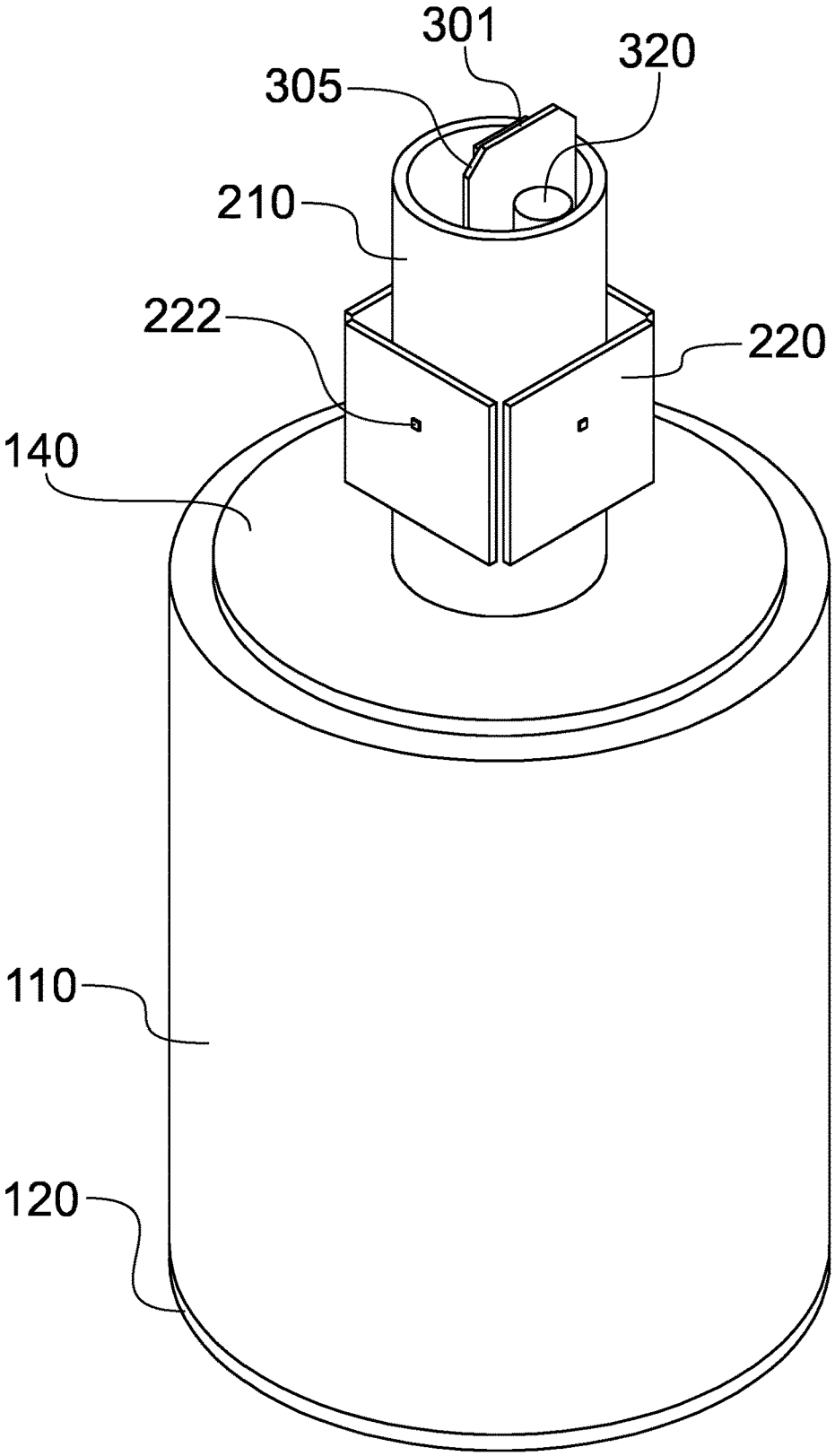
FIG. 3 illustrates a perspective view of a simplified version of the beacon light device of FIG. 1 with the light tower and cover removed.

The cross-sectional view shown FIG. 2 reveals the construction and internals of the beacon light device 1000 in greater detail. Firstly, it is noted that the bottom lid 120 and top lid 130 are different to one another. The bottom lid 120 includes an end plate 124 extending across the bottom lid 120 and forming a mounting platform. The connectors 122 run through the end plate 124 of the bottom lid 120. The top lid 130, however, is a frame without an integrated end plate. The top lid 130 secures a transparent cover 400 against the enclosure 100. More specifically, the cover 400 has a bottom flange 401 which is pressed against the top end surface of the body 110 by the top lid 130. A seal may be provided between the bottom flange 401 of the cover 400 and the body 110 of the enclosure 100 for sealing the internals of the beacon light device 1000 from the elements. Alternatively, the seal may be provided between the top lid and the body of the enclosure (not illustrated). The present construction therefore provides for an effective sealing of the device with only two sealing surfaces. Otherwise the cover 400 is a conventional transparent dome which does not affect the light output of the beacon light device 1000. In other words, the cover 400 does not have optically distorting properties so that the light output may pass through the cover 400 uninterrupted. Suitable materials for the cover 400 include glass and optical grade polymers, such as polycarbonate, acryl, polystyrene, etc.

The top lid 130 and the cover 400 also secure an end plate 140 against the body 110 of the enclosure. The top end of the body 110 includes a recess for receiving the end plate 140 which serves as mounting platform for a light tower 200 and as a feedthrough for the exposed part of a circuit board 300. The bottom flange 401 of the cover 400 extends inbound over the end plate 140 locking it into place. The end plate 140 includes an opening 142 which is defined by an edge 141. In the illustrated embodiment the edge is circular thus producing an equally circular opening 142. It should, however, be understood that other shapes are also foreseeable to provide a similar effect which will be discussed at greater length hereafter.

As briefly mentioned above, a light tower 200 is provided to the space between the end plate 140 and the cover 400. The light tower 220 is attached to the end plate 140 by a bracket (not shown), welding, threading, etc., or it is formed as an integral part of the plate through additive manufacturing, i.e. casting or 3D printing. The light tower 200 has a hollow body 210. The inner space of the body 210 houses an exposed part of the circuit board 300. The outer surface of the body 210 hosts a plurality of light sources. In the illustrated embodiment the light source includes an LED circuit board 220 which carries at least one LED chip 222 and a lens 221 covering the LED chip 222. The LED circuit board or boards are supplied with control and power signals by the circuit board 300 through a cable connection running through a particular passage in the body or end plate of the enclosure or through the hollow body 210. The cables running from the LED circuit boards terminate to terminals inside the body, whereby the circuit board 300 may be connected to these terminals with adequate leads. The illustrated exemplary light tower 220 features eight such light sources arranged in two angularly deviated layers of four light sources. The body 210 of the light tower has an octagonal cross-section so as to provide four faces at a 90 angles on both layers with a 45-degree angle deviation between the layers. The light tower 200 may include separate LEDs for a visible and non-visible spectrums of light. FIG. 1 shows each LED circuit board 222 featuring a lens 221 for LEDs 222 producing light in the visible spectrum and separate IR lenses 223 for LEDs producing light in the non-visible spectrum. Both types of LED and lens may be mounted on the same circuit board 222.

FIG. 2 also reveals the novel construction of the circuit board 300 of the beacon light device 1000. According to the illustrated embodiment, the circuit board 300 features three sections, namely a leading board section 301, a neck board section 302, and a trailing board section 303. The circuit board 300 is shaped such that the section that is inside the enclosure 100, namely the trailing board section 303 is relatively wide for the purposes of being able to host a large number of electronic components, such as the power supply, power electronics, and control circuitry for the LEDs. The circuit board 300 is mounted to the end plate 124 of the bottom lid 120 with a simple bracket 123. The trailing board section 303 need not be able to fit through the opening 142 of the end plate 140. The neck board section 302 is shaped and dimensioned to fit through the opening 142 and along the space inside the hollow body 210 of the light tower 200.

The neck board section 302 may therefore be narrower than the trailing board section 303. On the other hand, the neck board section 302 is narrower than the leading board section 301, whereby a shoulder 304 is created there between.

The leading board section 301 is also dimensioned to fit through the opening 142 and along the space inside the hollow body 210 of the light tower 200. However, the leading board section 301 can only be pushed through the opening 142 in a certain position as will be discussed in greater detail here after. The leading board section 301 protrudes outside the enclosure and at least partly outside light tower 200 so as to expose the leading end of the leading board section 301. The electronic component or components 310 mounted on the leading board section 301 are designed to be visible to the outside through the transparent cover 400. As a result, electronic components 310, such as WIFI chips, GPS chips, photocells, alarm LEDs, etc. are more effective as they are not covered by the enclosure 100. A damper 320, such as rubber isolator, is provided between the body 210 of the light tower 200 and the circuit board 300 to prevent vibrations of the circuit board 300. The damper 320 may be designed to maintain the circuit board 300 in slight tension.

Let us turn next to FIGS. 3 to 6 which provide a simplistic illustration of the cooperation between the circuit board 300 and the rest of the beacon light device 1000. In the simplistic illustration the profile of the bodies 110, 210 has been changed to cylindrical. In a general sense the enclosure 100, light tower 200, circuit board 300, and cover 400 remain assembled during use. During assembly and maintenance, a circuit board sub-assembly of the circuit board 300 and the bottom lid 120 are moved in respect to the rest of the assembly.

Figure 4:
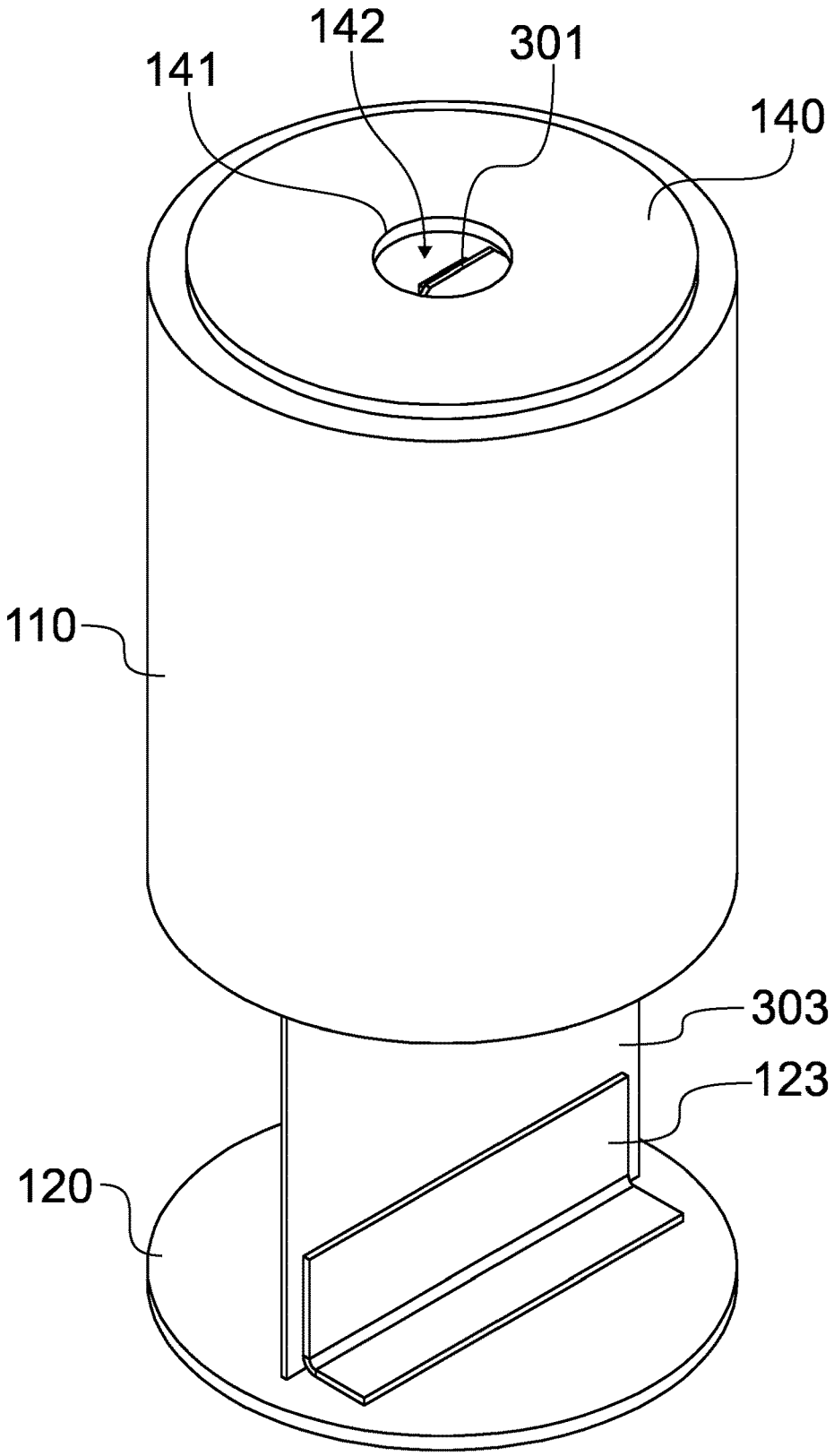
FIG. 4 illustrates a perspective view of the simplified beacon light device of FIG. 3 in during assembly or disassembly.
Figure 5:
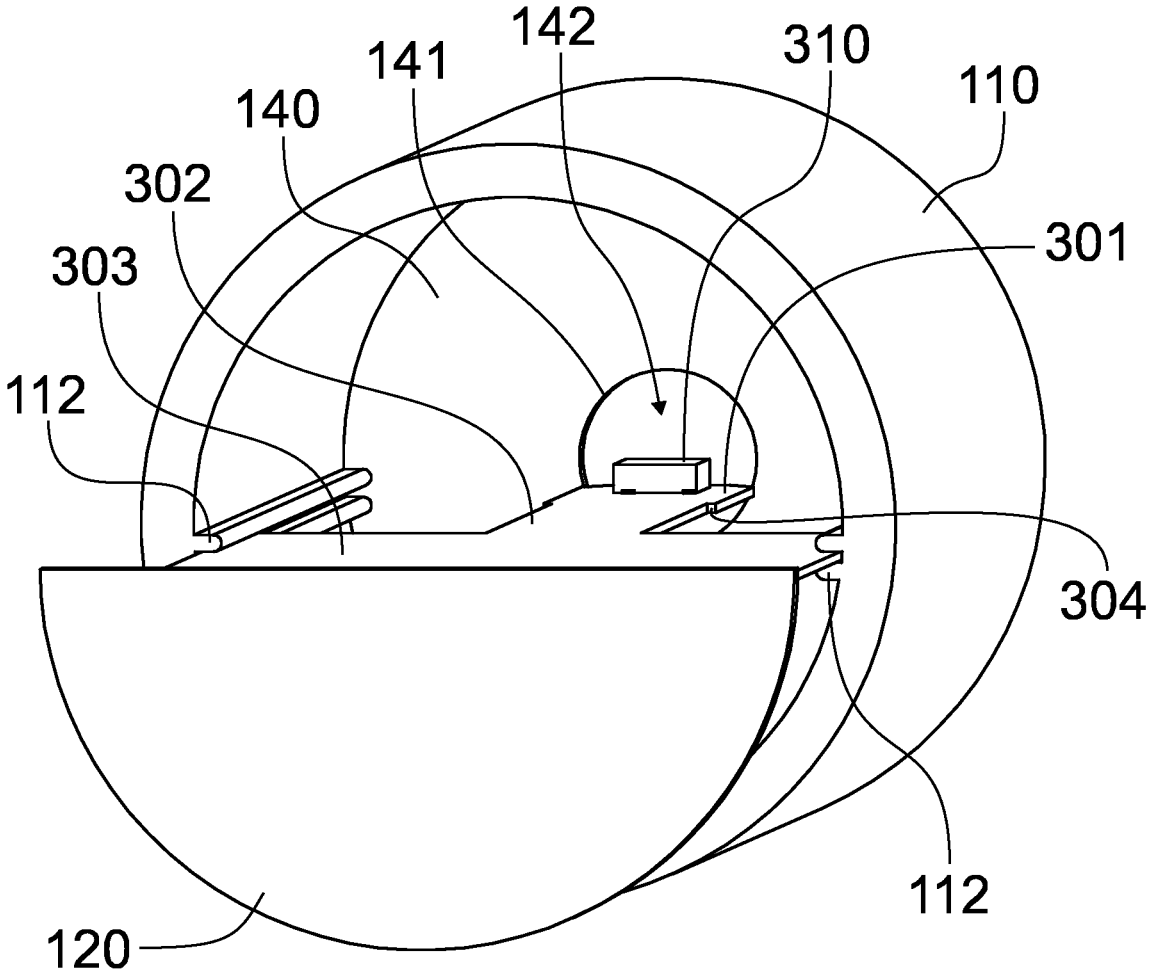
FIG. 5 illustrates a bottom view of the simplified beacon light device of FIG. 4.
Figure 6:
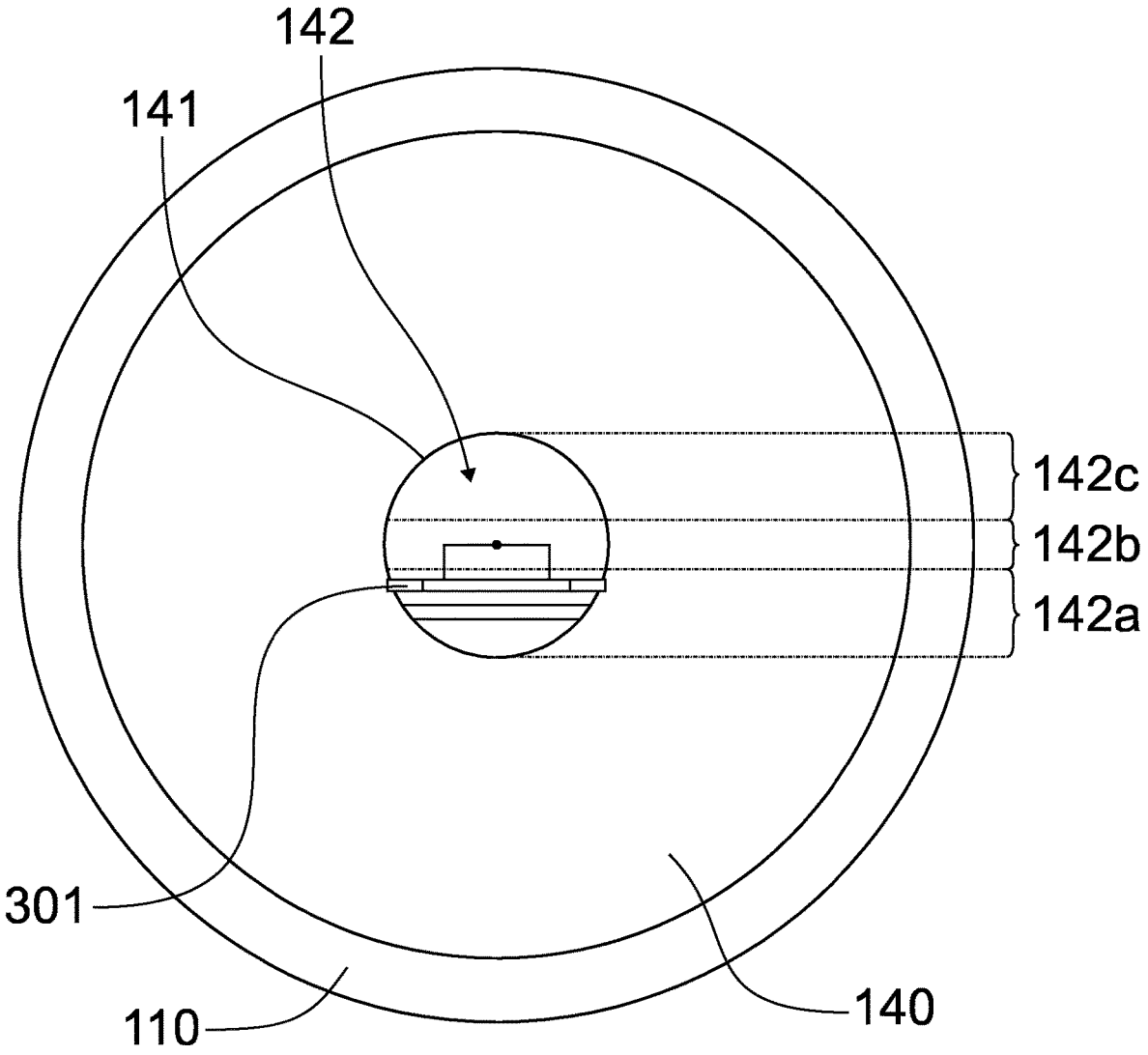
FIG. 6 illustrates a top elevation view of a simplified version of the beacon light device of FIG. 1 with the light tower and cover removed.

Upon final stages of assembly and with the enclosure 100, top lid 130, end plate 140, light tower 200, and cover 400 in place, the circuit board sub-assembly 120, 300 is installed by introducing the circuit board 300 into the enclosure 100. As is shown in FIGS. 4 and 5, the leading board section 301 enters the enclosure 100 first. The side edges of the trailing board section 303 are lined up with corresponding guides 112 on the inner surface of the body 110 of the enclosure 100. The guides 112 thus extend along the main extending dimension of the circuit board 300. The insertion is continued until the leading board section 301 makes contact with the edge 141 of the opening 142 on the end plate 140. The end edge of the leading board section 301 includes reliefs 305, such as chamfers. When the contact is initially made, the circuit board 300 approaches the opening 142 at a narrow opening section 142*a* shown in FIG. 6, where the light tower has been removed for illustrational purposes. The opening 142 may be divided into sections that can prevent or permit the passage of the leading board section 301. The sections are in the present context referred to as the narrow opening section 142*a*, 142*c* and the wide opening section 142*b*, respectively. In the circular example of FIG. 6, the opening 142 has two narrow opening sections 142, 14*c* with one wide opening section 142*c* there between. The narrow opening section 142*a*, 142*c* is dimensioned to be narrower than the leading board section 301 to achieve the passage preventing effect. On the other hand, the narrow opening section 142*a*, 142*c* is dimensioned to be wider than the neck board section 302 to allow the passage of the neck board section 302 through the opening. The wide opening section 142*b*, on the other hand, is dimensioned to be wider than the leading board section 301 to achieve the passage permitting effect.

During the insertion movement, the relieved corners of the leading board section 301 will automatically guide the leading board section 301 towards the wide opening section 142*b*, i.e. towards the middle of the opening 142. It should be noted that the center point 143 of the opening, i.e. the passage permitting section of the opening, is offset from the normal main extending dimension of the circuit board 300, when installed. During the passage through the opening 142, the circuit board 301 is according to one embodiment manipulated from a normal planar state to a non-planar state. The simplest way to achieve such manipulation is to provide for elastic deformation by selecting the material of the circuit board and the circuitry such to allow for a slight bending in a resilient manner. To facilitate the passage, the operator may also promote the deformation by bending the circuit board by hand through the relatively short body 210 of the light tower 200.

Alternatively, the circuit board may include a mechanical joint (not illustrated), e.g. a hinge, between trailing board section and the neck board section with jumper wires passing the joint.

Instead of manipulation between a planar and non-planar state, the guides may, according to another embodiment, feature enough play to allow for the whole circuit board to be translated between alignment with the passage preventing and permitting sections of the opening (not illustrated). Such embodiment would require additional means for securing the circuit board into place after assuming alignment with the narrow opening section of the opening. Such means may include elastic fillings, wedges, or other pieces for filling the play between the guide and the circuit board.

With the leading board section 301 cleared through the opening 142, the circuit board 300 assumes its normal planar non-alignment with the wide opening section 142*b*. The insertion movement towards the cover 400 is continued with the neck board section 302 extending through the opening 142 at the narrow opening section 142*a*. The insertion movement is continued until the bottom lid 120 meets the end surface of the body 110 of the enclosure 100. With the lid 120 fixed into the body 110, the internals, i.e. the light tower 200 and the circuit board 300, are sealed from the elements with two seals between the body 110 of the enclosure and the lids 120, 130 or cover 400. In addition, electronic components 310, which benefit from being visible to the ambient, are visually exposed through the transparent cover 400 by protruding through the hollow light tower 200 with aid of the elongated circuit board 300.

While the present construction is considerably convenient to assemble, disassembly for maintenance purposes is particularly efficient. After removing the affixers 121, the bottom lid 120 is free to become detached from the body 110. At that point, there is a risk of dropping the circuit board sub-assembly 120, 300. However, because the neck board section 302 extends at the passage preventing narrow opening section 142*a*, the circuit board sub-assembly 120, 300 cannot inadvertently fall out of the enclosure 100. Should the operator suddenly release the sub-assembly 120, 300, the neck board section 302 would fall through the opening 142 until the shoulder 304 between the neck board section and the wider leading board section 301 would make contact with the end plate 140 at the narrow opening section 142*a* thus stopping the motion. This position may also be used for maintenance purposes by leaving the sub-assembly 120, 300 hanging for servicing other internals of the beacon light device 1000, such as checking the connections of the terminals 122 or replacing the bottom seal.

The circuit board assembly 120, 300 is then finally released from the enclosure 100 by performing the passage routine described above in reverse order. According to the elastic deformation or mechanical joint embodiment, the operator may manipulate the circuit board 300 by pushing the leading board section 301 into alignment with the passage permitting wide opening section 142*a*. According to the play embodiment, the operator may remove the fillings between the guide and the circuit board for facilitating said alignment.

Beacon light devices 1000 are typically installed in locations that are difficult to get to, e.g. remote buoys, wind turbine towers, etc. It is therefore beneficial to be able to replace the electronics of the device without detaching the device from the location for service. With aid of the novel solution, the operator may arrive to the device with a new circuit board sub-assembly 120, 300 and simply replace the entire circuit board 300. The new circuit board sub-assembly 120, 300 also includes a new seal readily installed. Because the circuit board 300 may be detached without touching the optics or detaching the device from the host structure, the device need not be re-oriented after servicing.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", i.e. a singular form, throughout this document does not exclude a plurality.

REFERENCE SIGNS LIST

| No. | Feature |
|---|---|
| 100 | beacon light device |
| 100 | enclosure |
| 110 | body |
| 111 | bracket |
| 112 | guide |
| 120 | bottom lid |
| 121 | affixer |
| 122 | terminal |
| 123 | bracket |
| 124 | end plate |
| 130 | top lid |
| 131 | affixer |
| 140 | end plate |
| 141 | edge |
| 142 | opening |
| 142a | narrow opening section |
| 142b | wide opening section |
| 142c | additional narrow opening section |
| 143 | center point |
| 200 | light tower |
| 210 | body |
| 220 | LED circuit board |
| 221 | lens |
| 222 | LED chip |
| 223 | IR lens |
| 300 | circuit board |
| 301 | leading board section |
| 302 | neck board section |
| 303 | trailing board section |
| 304 | shoulder |
| 305 | relief |
| 310 | electronic component |
| 320 | damper |
| 400 | cover |
| 1000 | beacon light device |

The invention claimed is:

1. A beacon light device comprising:

a circuit board comprising:

a leading board section having a width, and a neck board section having a width that is smaller than that of the leading board section, and an enclosure at least partially enclosing the circuit board and comprising an opening which comprises:

a wide opening section having a width equal to or greater than that of the leading board section for permitting passage of the leading board section through the opening, and a narrow opening section having a width that is smaller than that of the leading board section for preventing passage of the leading board section through the opening, and wherein the neck board section extends, when installed to the enclosure, through the opening at the narrow opening section of the opening.

2. The beacon light device according to claim 1, wherein the leading board section is, when installed to the enclosure, offset in respect to the wide opening section of the opening.

3. The beacon light device according to claim 1, wherein, the circuit board comprises a main extension dimension which is non-aligned with the wide opening section of the opening so that, when installed, the circuit board cannot be pulled through the opening along the main extension dimension of the circuit board.

4. The beacon light device according to claim 3, wherein the opening is defined by an edge which is provided to the enclosure, which edge delimits an imaginary plane, the normal of which is parallel to the main extension dimension of the circuit board.

5. The beacon light device according to claim 1, wherein the leading board section is, when installed to the enclosure, at least partly, visible to the outside.

6. The beacon light device according to claim 1, wherein:

the circuit board comprises an electronic component mounted on the leading board section, and wherein the electronic component is outside the enclosure, when the circuit board is installed to the enclosure.

7. The beacon light device according to claim 1, wherein:

the light beacon device comprises a light tower mounted to the enclosure, which light tower comprises a hollow body which is in communication with the opening of the enclosure, and wherein the circuit board extends through the hollow body of the light tower.

8. The beacon light device according to claim 6, wherein the electronic component is visible to the outside.

9. The beacon light device according to claim 7, wherein the light beacon device comprises a transparent cover which:

is attached to the enclosure, and which covers the light tower.

10. The beacon light device according to claim 1, wherein the circuit board is configured to be manipulated during assembly and disassembly between:

a planar state, in which the leading board section cannot pass through the wide opening section, and a non-planar state, in which the leading board section may pass through the wide opening section.

11. The beacon light device according to claim 10, wherein the circuit board is configured to be elastically deformed between the planar and non-planar state.

12. The beacon light device according to claim 10, wherein the circuit board comprises a mechanical joint which is configured to provide manipulation of the circuit board between the planar and non-planar state.

13. The beacon light device according to claim 1, wherein:

the enclosure comprises a body with a bottom end and an opposing top end of the body, the light beacon device comprises a bottom lid which is configured to be fixed to the body for closing the bottom end, and wherein the circuit board is fixed to the bottom lid.

14. The beacon light device according to claim 9, wherein:

the enclosure comprises a body with a bottom end and an opposing top end, the light beacon device comprises an end plate at the top end of the body, the light tower extends from the end plate, and wherein the opening is provided to the end plate.

15. The beacon light device according to claim 14, wherein:

the body of the enclosure, the light tower, and the cover form a fixed sub-assembly which remains stationary during servicing, and wherein the bottom lid and the circuit board form a circuit board sub-assembly which is movable in respect to the fixed sub-assembly during servicing.

16. The beacon light device according to claim 3, wherein the opening is defined by an edge which is provided to the enclosure, which edge delimits an imaginary plane, the normal of which is parallel and offset in respect to the main extension dimension of the circuit board.

17. The beacon light device according to claim 3, wherein the circuit board further comprises a trailing board section.

* * * * *